US010549885B2

(12) United States Patent
de Bokx et al.

(10) Patent No.: US 10,549,885 B2
(45) Date of Patent: Feb. 4, 2020

(54) PALLET AND LOGISTIC SYSTEM

(71) Applicant: Ahrma Holding B.V., Deventer (NL)

(72) Inventors: Erik de Bokx, Holten (NL); Frederik Ekkel, Nuenen (NL)

(73) Assignee: Ahrma Holding B.V., Deventer (NL)

( * ) Notice: Subject to any disclaimer, the term of this patent is extended or adjusted under 35 U.S.C. 154(b) by 0 days.

(21) Appl. No.: 16/093,150

(22) PCT Filed: Apr. 14, 2017

(86) PCT No.: PCT/NL2017/050237
§ 371 (c)(1),
(2) Date: Oct. 12, 2018

(87) PCT Pub. No.: WO2017/179985
PCT Pub. Date: Oct. 19, 2017

(65) Prior Publication Data

US 2019/0168912 A1 Jun. 6, 2019

(30) Foreign Application Priority Data

Apr. 14, 2016 (NL) ..... 2016609

(51) Int. Cl.
*B65D 19/44* (2006.01)
*B65D 19/00* (2006.01)

(52) U.S. Cl.
CPC ..... *B65D 19/44* (2013.01); *B65D 19/0012* (2013.01); *B65D 2519/00029* (2013.01);
(Continued)

(58) Field of Classification Search
CPC ..... B65D 2519/00368; B65D 2519/00547; B65D 2519/00552; B65D 2519/00034
(Continued)

(56) References Cited

U.S. PATENT DOCUMENTS 3,645,215 A * 2/1972 Kirkpatrick ..... B65D 19/0069 108/57.23
4,292,899 A * 10/1981 Steffen ..... B65D 19/0095 108/51.11

(Continued)

FOREIGN PATENT DOCUMENTS

DE 202008007824 U1 11/2008
DE 102014002832 A1 8/2015
WO 00/15507 A2 3/2000

OTHER PUBLICATIONS

Edison, RM2 International, "Risks reduced, potential raised", Apr. 21, 2015.

*Primary Examiner* — Jose V Chen
(74) *Attorney, Agent, or Firm* — N.V. Nederlandsch Octrooibureau; Catherine A. Shultz; Katelyn J. Bernier

(57) ABSTRACT

A pallet has a deck, a skid and a plurality of blocks, spacing the skid from the deck. The blocks comprise spacer portions and sleeve portions, wherein the sleeve portions may extend above and below the spacer portions. The deck and skid peripheral edges are cut away such that the deck and skid can be recessed with the blocks. The pallet constructed in this way can advantageously be made in any conventional size to meet the relevant norm or standard, while benefitting from the fact that the sleeve portions protect the edges of the deck and/or skid from impact. Furthermore, any impact imparted on the blocks is transmitted by the respective sleeve to the deck and/or skid. The elements of the pallet are connected without mechanical fasteners and the pallet can be easily repaired by removal and replacement of individual elements. A logistic system is also described.

20 Claims, 7 Drawing Sheets

(52) U.S. Cl.
CPC ..... *B65D 2519/00064* (2013.01); *B65D 2519/00273* (2013.01); *B65D 2519/00288* (2013.01); *B65D 2519/00318* (2013.01); *B65D 2519/00815* (2013.01)

(58) Field of Classification Search
USPC ..... 108/51.11, 51.3, 57.25, 56.1, 56.3
See application file for complete search history.

(56) References Cited

U.S. PATENT DOCUMENTS 5,197,395 A * 3/1993 Pigott ..... B65D 19/0012 108/56.1
5,197,396 A * 3/1993 Breezer ..... B65D 19/0012 108/56.1
5,413,052 A * 5/1995 Breezer ..... B65D 19/0012 108/56.1
5,829,364 A * 11/1998 Urbach ..... B65D 19/0091 108/56.1
5,960,721 A * 10/1999 Huetteman ..... B65D 19/0095 108/57.17
6,418,861 B1 7/2002 Flam
8,671,848 B2 * 3/2014 Randall ..... B65D 19/0095 108/51.11
2004/0218276 A1 11/2004 Apps et al.
2005/0193929 A1 * 9/2005 Ingham ..... B65D 19/0038 108/56.3
2005/0237184 A1 * 10/2005 Muirhead ..... B29C 51/02 340/539.13
2005/0241548 A1 * 11/2005 Muirhead ..... B29C 51/02 108/51.3
2006/0032413 A1 * 2/2006 Ogburn ..... B65D 19/0012 108/57.25
2008/0127865 A1 * 6/2008 Tung-Cheng ..... B65D 19/12 108/56.3
2009/0114129 A1 * 5/2009 Smith ..... B29C 70/865 108/57.25
2010/0229764 A1 * 9/2010 Ingham ..... B65D 19/0095 108/51.3
2011/0303128 A1 * 12/2011 Linares ..... B65D 19/0012 108/51.3
2012/0325125 A1 * 12/2012 Apps ..... B65D 19/0014 108/57.25
2013/0014676 A1 * 1/2013 Imbrecht ..... B65D 19/18 108/57.25
2013/0145971 A1 * 6/2013 Federl ..... B65D 19/0059 108/57.25
2013/0160680 A1 * 6/2013 Ten Bok ..... B29C 44/0407 108/50.11
2014/0283714 A1 * 9/2014 Wahl ..... B65D 19/0016 108/51.11
2014/0302277 A1 10/2014 Van Der Horst et al.
2015/0210426 A1 * 7/2015 Funaki ..... B65D 19/385 108/53.3
2015/0298854 A1 * 10/2015 Linares ..... B65D 19/0018 108/11
2016/0114936 A1 * 4/2016 Muirhead ..... B65D 19/0012 108/25

* cited by examiner 60
64
62
63
65
67
68
61
66
69

PALLET AND LOGISTIC SYSTEM

BACKGROUND OF THE INVENTION

1. Field of the Invention

The present invention relates to pallets and the like for the transportation of goods. The invention also relates to the use of tracking devices to collect and provide pallet and logistics related information.

2. Description of the Related Art

The pallet is one of the most ubiquitous elements of the transport and logistic network that serves the world's economies. The wooden pallet has been in use in its present form since the 1930's, coinciding with the invention of the fork-lift truck. In fact, the two are complementary and the pallet is little more than a means of allowing a load to be readily picked up by a fork-lift device or similar pallet jack. Wooden pallets come in various sizes and qualities and are manufactured according to a number of different norms. In Europe, the most common pallet is the EuroPallet range as specified by the European Pallet Association.

Estimates of the number of pallets in circulation worldwide at any one time are difficult but the number of new pallets produced annually is estimated to be upwards of 3 billion units. Frequently, these pallets are used once or twice only and then become refuse. A primary reason for this lack of re-use is the relatively high damage rate. The logistics of implementing a return and reuse system are difficult if damage exceeds a minimum amount.

Efforts to improve the circulation of pallets have focussed on the use of more robust pallets e.g. made of aluminium or steel. Plastic pallets have also been proposed. Although such alternatives may be more robust, their cost has so far prevented significant market penetration.

It would be desirable to provide a pallet that at least partially overcomes problems related to reusability.

BRIEF SUMMARY OF THE INVENTION

According to the invention there is provided a pallet, comprising: a deck, having a deck upper surface, a deck lower surface and a deck peripheral edge; a skid, having a skid upper surface, a skid lower surface and a skid peripheral edge; and a plurality of blocks, spacing the skid from the deck, the blocks comprising spacer portions and sleeve portions, wherein the sleeve portions extend above and/or below the spacer portions and the deck and/or skid peripheral edges are cut away such that the deck and/or skid can be recessed with the blocks. The pallet constructed in this way can advantageously be made in any conventional size to meet the relevant norm or standard e.g. EuroPallet or North American standard, while benefitting from the fact that the sleeve portions protect the edges of the deck and/or skid from impact. Furthermore, any impact imparted on the blocks is transmitted by the respective sleeve to the deck and/or skid.

Most preferably, both the deck and the skid are recessed with the blocks although it will be understood that benefits of the invention may be achieved even if only the deck is recessed or even just the skid. As indicated above, the pallet may be constructed to any required norm. In general, it will comprise nine blocks, the deck will be closed and the skid will be a one-piece open form having five members. Three member skids may also be used and the skilled person will recognise that in this case, the skid is no longer a single item but will nevertheless fall within the scope of the claim. Furthermore, it will be understood that of the nine blocks, the four corner blocks will have a sleeve portion around two sides, the four middle blocks will have a sleeve portion along one side and the central block will be without a sleeve portion.

In an embodiment, the sleeve portions can extend upwards to level with the deck upper surface. They can also extend downwards to level with the skid lower surface. Clearly, there is no need for the sleeve portions to be flush with these respective surfaces for the benefits of recessing can be achieved. If the sleeve portions extend beyond the respective surfaces, they may interfere with the load supporting function of the pallet, although in certain circumstances this may not be excluded.

In one preferred embodiment, the deck and/or skid peripheral edges may be cut away by a distance corresponding to a width of the sleeve portions, whereby an exterior surface of the sleeve portions is co-linear with the deck and/or skid peripheral edges. The sleeve portion thus occupies the volume cut away and the external dimensions of the pallet may be the same as if the cut away portions had not been removed, thus assuring that the pallet meets the requirements of the respective norm.

Advantageously, the deck peripheral edges are chamfered in the regions between the blocks to assist fork entry. Chamfering may take place in a single procedure together with the forming of the cut away portions. The same may apply to the skid, with chamfering taking place in the opposite direction although it will be understood that the deck is more prone to accidental engagement and damage by the forks of a fork-lift or the like than is the skid.

According to a particularly important aspect of the invention, the elements of the pallet, namely the deck, the skid and the blocks are each individually coated with a cured resin coating. This may ensure that the whole construction is waterproof and non-porous. The resulting pallet is easily cleaned for re-use and is much more hygienic. The cured resin coating may additionally improve its durability and resistance to various forms of damage. Various forms of coating may be applicable including polyurea resin, polyurethane resin, polyaspartic resin, epoxy resin, polyurethane-polyurea hybrid resin or mixtures thereof. Polyurethane resin has shown itself to be particularly appropriate and the coating is preferably of a thickness of from 0.5 mm to 1.5 mm.

According to another aspect of the invention, the elements of the pallet, namely the deck, the skid and the blocks may be individually connected to each other by means of an adhesive. This in itself may not be considered particularly innovative but by an appropriate choice of the adhesive, the pallet may be easily repaired by replacement of individual elements that have become worn or damaged. In particular, the adhesive may be one that forms a joint that is adequately strong to withstand the forces applied to the pallet but which can nevertheless be separated or otherwise removed.

The adhesive may be of the type that remains elastic even after curing or setting and that can be subsequently cut with a wire or a knife to separate the elements or otherwise remove and replace a damaged element. One preferred adhesive is a two-component modified silane, elastic adhesive. In a particularly preferred embodiment, the elements of the pallet are only held to each other by means of the adhesive. This means that the deck, the blocks and the skid are joined to each other without mechanical fasteners, in particular without the use of nails, staples, screws or bolts. A further advantage of such an adhesively assembled pallet is that the resilient connection between the elements may better absorb shocks, preventing damage to the pallet.

As indicated above, the elements of the pallet may be coated with a resin coating. The interaction between the coating and the adhesive may ensure a beneficial effect whereby the elements can be securely bonded together but the adhesive bond may be broken or cut without damage to the coating. Preferably, the relative tensile strengths of these compositions may be chosen such that the cured resin has a tensile strength Tresin and the adhesive has a tensile strength Tadhesive with Tresin>Tadhesive.

The deck may be of any particular construction according to the intended use. In one embodiment, the deck comprises a skin-core construction. The core may be any appropriate lightweight material that ensures adequate strength in combination with the skin. Such core materials are generally well known and include honeycell, foam and lattice arrangements of various materials. Preferably the core is waterproof and fire retardant. One example of a panel that can be used as the deck is disclosed in US2014/0302277, the contents of which are herein incorporated by reference in their entirety.

In the case of a skin-core construction, the deck peripheral edge may comprises an edge member having a width that is sufficiently wide to allow the cut away portions to be removed without excessively weakening the construction. Preferably, the edge may be at least twice the width of the sleeve portions. The thickness of the deck peripheral edge also allows chamfering to take place as discussed above and hereinafter. In order to further improve the damage resistance of the pallet, the deck peripheral edge may be provided with a protective bumper, preferably of HDPE. This may be provided along the portions of the deck peripheral edge between the blocks, If a chamfer is present, it may cover the chamfer.

The pallet described above and hereinafter may be provided with an electronic tag containing data identifying the pallet. The fact that the pallet may be re-used more frequently than conventional wooden pallets makes the use of an electronic tag more relevant and cost effective. This applies in particular to the case where the electronic tag is an active e.g. RFID tag containing a wireless radio chip that can communicate with a remotely located receiver. The tag may be located and mounted in or on the centre block although other locations may also be considered. Preferably the wireless radio chip may be arranged to operate under a low power sensor network protocol, typically capable of communication up to around 300 metres. Examples of such protocols are WiFi, Bluetooth, Zigbee, Z-wave, 6LoWPAN, BlueRobin and the likes. Receivers may be placed at the premises of the customers of the pallets (factories, warehouses, retail locations etc.) and the above mentioned tags can then communicate towards gateways, which are all connected to an internet cloud based system.

In a still further embodiment, the above mentioned tags may be provided with a receiver protocol, so that the pallet can also listen to and receive signals from nearby Bluetooth beacons. With this system it is possible to create a network of fixed positions inside a factory, warehouse, retail location and the like, via which the pallets can obtain and provide a very accurate location coordinate.

In a still further embodiment, the pallet may be provided with an electronic tag including a 3G/4G/5G/LTE, LoRa, SigFox or other LPWAN modem chip. Such a pallet is capable of communicating towards a gateway of an operator such as KPN, AT&T, Vodafone etc., preferably with long range wireless transmission, sometimes even hundreds of kilometres. Advantages of this configuration is that there is no need for the installation of an own gateway infrastructure and it will also be possible to track pallets even if they are beyond the premises of the customers. It is also possible in such a system to still use an own gateway on the premises of the customer to send high bandwidth data to the cloud server and only use the network of the mentioned operators when the pallets are remote e.g. outside the range of the own network. In this manner, costs are saved since the external operator network is only used on specific occasions In another embodiment a "master pallet" is envisioned. This pallet has a so called super-tag embedded in its structure. This super-tag is in effect a small battery-powered gateway, connected via an 3G/4G/5G/LTE modem chip to the internet. This master pallet then receives all messages from surrounding pallets in-range and transmits those to the internet. In this configuration there is no need for the installation of a gateway infrastructure at the premises of the customer. It will be sufficient to have a well selected distribution of normal pallets and master pallets in a pallet pool. Such a master pallet may also be provided with other identification devices including e.g. GPS positioning for defining the momentary position of the master pallet.

In an embodiment, the electronic tag may be arranged to transmit a ping signal to a receiver or gateway device on a periodic basis. The ping signal may be transmitted at adjustably programmable intervals depending upon the need for data. In this manner battery power may be conserved e.g. when the pallet is stationary. The gateway may be either mobile or stationary i.e. it may be in wireless communication with the receiver or it may be wired via e.g. an Ethernet connection.

Advantageously, the electronic tag may be provided or associated with one or more appropriate sensors. The sensors may e.g. detect ambient conditions selected from the group comprising: temperature, humidity, light, UV radiation, CO2 and hazardous gas. The skilled person will be well aware of the wide range of detection possibilities that may be contemplated depending on the sort of loads intended for the pallets. The electronic tag may also be provided with memory in order to store measurements and events. In this manner, a complete record of a shipment may be made, allowing a supplier to determine any undesirable conditions encountered by the product during its supply. The information may also be gathered during transit, e.g. if a gateway device is located within range of the pallet such as on a master pallet or in the truck.

The electronic tag may also contain a weight sensor e.g. to determine the load being carried on the pallet. The weight sensor may be located and mounted in or on the centre block although other locations may also be considered. The electronic tag and/or the wireless radio chip may also be located on or even inside the central block as a matter of convenience or to otherwise protect it from tampering.

Additionally to the above described sensors, the electronic tag may comprise or be associated with an activity monitor for detecting movement of or impact on the pallet. As will be described further below, such activity monitors which may comprise solid state accelerometers or the like, can be implemented to further monitor the movement and handling of the pallet and can be used to extend battery life of the electronic tag.

The invention also relates to a method of tracking a pallet or similar platform having an electronic tag as described above or hereinafter. The method may comprise receiving information by wireless transmission from the electronic tag located on the pallet to a receiver located at a remote location. Various communication protocols may be employed. As an example, communication may be as described in EP1275219, the contents of which are incorporated herein by reference in their entirety.

In one embodiment, the tag includes an activity monitor sensor for determining whether or not the pallet is in movement. The frequency at which information is transmitted may then be adjusted based on the presence or absence of such movement. For a pallet that is stationary for a period of time, there may be little need to monitor it. In this case, the tag may be put into a dormant mode in which it provides information only every 30 minute or even less. The frequency may be still further reduced, the longer that the pallet is motionless. On the other hand, if the pallet is in motion, transmission of information from the tag may take place more frequently e.g. once a minute or less. Other factors may also be monitored in order to determine the frequency of communication and the tag may only generate a signal when any one of these factors changes by a given value. In the case that the tag comprises a load sensor to determine whether the pallet is loaded or not, the tag may communicate at a low frequency if the pallet is empty, in particular if it is empty and stationary.

In the case that the tag includes an impact sensor, information relating to the time and degree of impact on the pallet is stored and subsequently transmitted to the receiver. It will be understood that the impact sensor may be a certain form of movement sensor i.e. an accelerometer having adequate resolution to determine the magnitude of an impact, with or without a load sensor to determine the momentary load on the pallet. This information may be used to determine the likelihood of damage to the pallet and also to goods carried on the pallet. In a similar manner, if the tag includes a temperature sensor, information relating to excessive temperatures is stored and subsequently transmitted to the receiver. This is of course primarily of relevance for goods transported by the pallet and not for the pallet itself and can be used to retrospectively determine whether unacceptable temperatures have been encountered by the goods in transit.

In one embodiment of the method, a gateway device may be provided and transmission from the electronic tag to the receiver may take place via the gateway device. In this context, a gateway device is intended to denote a device having communication capability allowing it to transmit data into a publically accessible network such as the internet or the telecommunications network. The gateway device may be mobile or stationary and may be hard-wired or wirelessly connected to the public network. As described above, the gateway device may even be provided on a master pallet whereby the pallet and the master pallet can be transported together. In that case, the master pallet may comprise a wireless radio chip and a 3G/4G/5G/LTE modem chip or similar device capable of wireless communication with the public network.

The skilled person will understand that once the information from the pallet has been transmitted from the tag to the public network, it may be stored e.g. in an internet database (cloud) and processed appropriately by a user. This may include the application of smart algorithms so that the optimal routing of pallets can be determined and implemented. Further individual and collective data analysis algorithms may be applied to the information derived from the pallets allowing a user or pallet owner to constantly monitor the status and condition of both the pallets and their loads.

The invention also relates to a method of manufacture of a pallet such as the one described above or hereinafter, comprising providing a barcode to a first side of the pallet, generated from an computer system, and subsequently providing the other three sides of the pallet with the barcode, whereby the barcode on the first side is read with an optical scanner and then copied onto the other three sides of the pallet. Since individual identification and labelling of a pallet is essential, efficient and fool-proof labelling in an automated production facility is highly desirable.

Still further, the invention relates to a method of repairing a pallet as described above or hereinafter when one or more of its elements is damaged The method may comprise removing a damaged element by cutting through the adhesive connecting the damaged element to a neighbouring element and connecting a replacement element to the neighbouring element by means of adhesive. The pallet may be disassembled entirely and rebuilt or just the individual element may be replaced. This may take place by cutting through the adhesive using a cutting wire. In one embodiment, the sleeve portion may be removed from a block, prior to separation of the block from the deck and/or skid.

According to a still further aspect of the invention there may be provided a pallet logistic system comprising: a plurality of pallets, each provided with an electronic tag capable of emitting a periodic communication signal (ping signal) containing data relating to that pallet; a plurality of gateways, arranged to receive the ping signals from pallets that are within range and transmit the data to a publically accessible network; and a logistic management application running on a programmable device, the logistic management application enabling a user to extract the data from the network and analyse the data to determine individual and collective information regarding the plurality of pallets. In this context, reference to a pallet may be a pallet as defined and described above or hereinafter.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
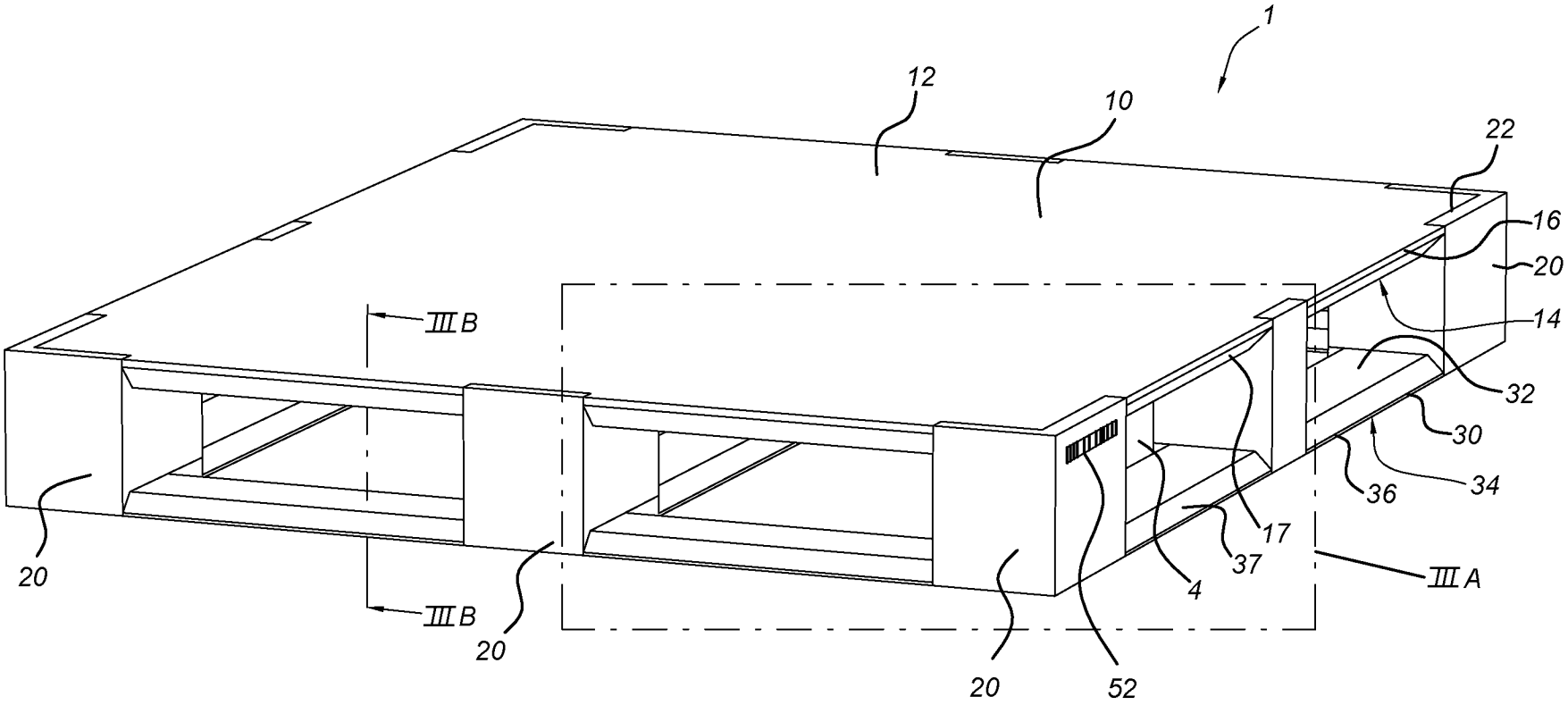
FIG. 1 shows a perspective view of a pallet according to the present invention.

FIG. 1 shows a perspective view of a pallet 1 according to the present invention in its ready to use state. The illustrated pallet is of conventional EuroPallet dimensions (1200 mm×800 mm×144 mm). It includes a deck 10 having a deck upper surface 12 a deck lower surface 14 and a deck peripheral edge 16. Blocks 20 are provided beneath the deck 10 and space the deck 10 from a skid 30. The skid 30 also has a skid upper surface 32 a skid lower surface 34 and a skid peripheral edge 36. Openings 4 between the blocks 20 allow the forks of a fork lift truck to be inserted under the deck 10 to engage the deck lower surface 14 for lifting the pallet 1 as is otherwise conventional.

Unlike conventional pallets, the blocks 20 are provided with sleeve portions 22 that extend upwards, covering the deck peripheral edge 16 to a position level with the deck upper surface 12. The sleeve portions 22 also extend downwards and overlap the skid peripheral edge 36. Furthermore, it may be seen that the deck peripheral edge 16 and the skid peripheral edge 36 are provided with chamfers 17, 37 at the location of the openings 4. This facilitates access by a fork-lift and reduces any damage due to the fact that an impact may be deflected. A barcode 52 is provided on block 20. In practice, the barcodes 52 will be placed on the diagonally opposing blocks 20, one on each external face (i.e. 4 barcodes 52 to each pallet).

Figure 2:
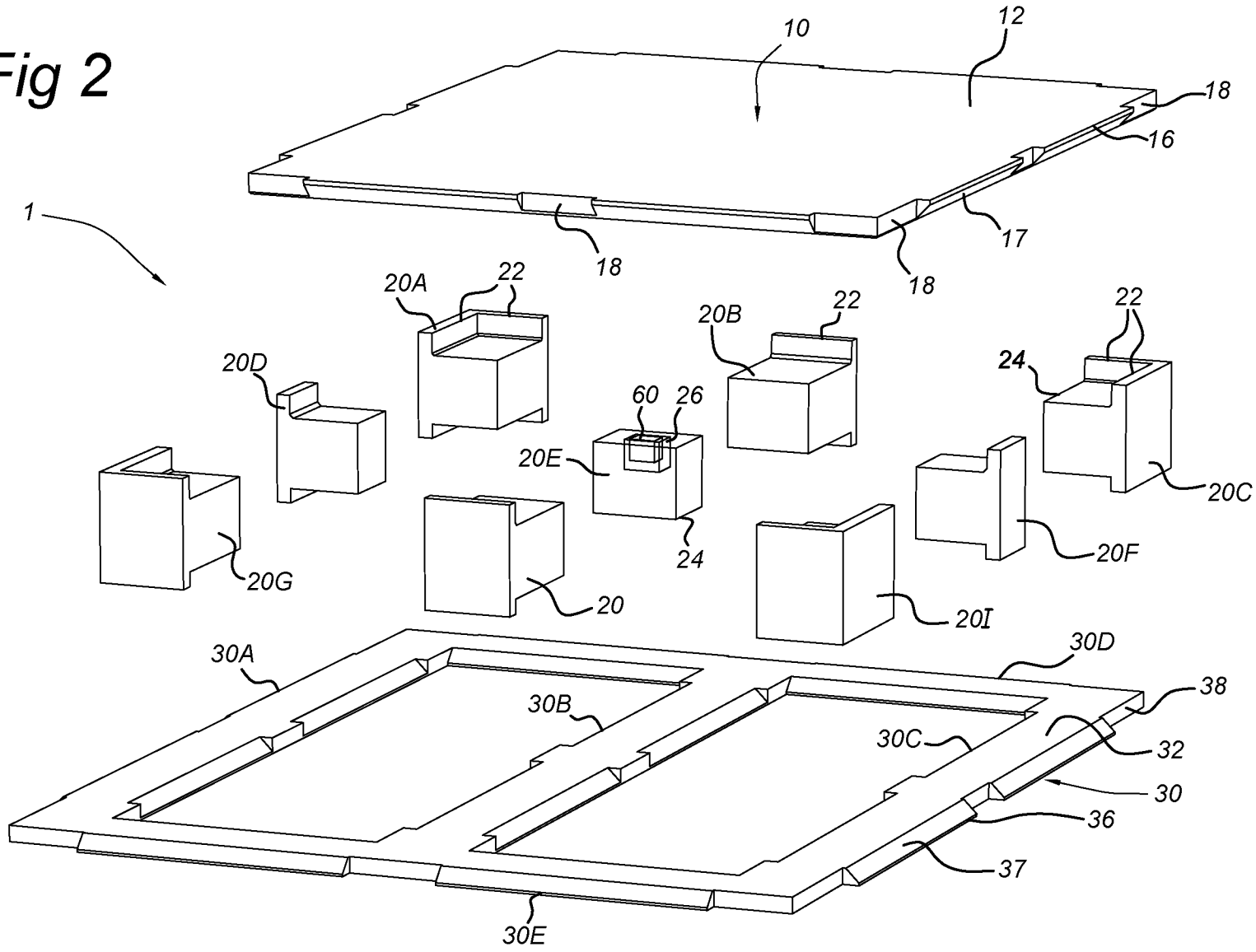
FIG. 2 shows the pallet of FIG. 1 in exploded perspective view.

FIG. 2 shows the pallet 1 of FIG. 1 in exploded view whereby the individual elements that form the pallet 1 can be better seen. Turning first to the deck 10, it can be seen that the deck peripheral edge 16 has cutaway regions 18 at the corners and in the middle of each side. Between the cutaway regions 18 are the chamfers 17. In this embodiment, the deck peripheral edge 16 is either cutaway or chamfered around the full periphery although it will be understood that these regions may be spaced from each other.

There are in total nine blocks 20A-I, of which all except the central block 20E, comprise sleeve portions 22 and spacer portions 24. The central block 20E comprises only a spacer portion 24. The corner blocks 20A, 20C, 20G and 20I all have angled sleeve portions 22, while the side blocks 20B, 20D, 20F and 20H in the middle of each side, have straight sleeve portions 22. The sleeve portions 22 all extend above the respective spacer portion 24 by a distance that corresponds to the thickness of the deck 10 and have a width that corresponds to a depth of the cutaway regions 18. This ensures that the deck 10 can be recessed into the sleeve portions 22 with an exterior surface of the sleeve portions 22 being co-linear with the deck peripheral edge 16. The central block 20E comprises a cavity 26 in which is located an electronic tag 60. The tag 60 is a proprietary electronic active RFID chip-based, track and trace device with incorporated battery, capable of transmitting over ranges of up to 300 metres, available from BM Innovations GmbH under the name BlueRobin™, operation of which will be described in further detail below. Other similar devices such as Bluetooth low power (BLE) devices may also be used.

The skid 30 is similar in terms of the skid peripheral edge 36, which has cutaway regions 38 at locations corresponding to the blocks 20. The parts of the skid peripheral edge that are not cut away are chamfered at chamfers 37. In the disclosed embodiment, the deck 10 is closed but it will be understood that open or apertured decks may be used as appropriate. The illustrated skid 30 is a five member skid having first, second and third skid members 30A-C and front and back braces 30D, E. The skid 30 may be of conventional wooden construction with the skid members 30A-E being glued and pegged together in conventional manner. Alternatively, the whole skid may be of MDF or the like unitary construction. In the illustrated embodiment, all of the skid members 30A-E have chamfers on all sides. It will be understood that chamfering can also be limited to just the skid peripheral edge 36.

Figure 3A:
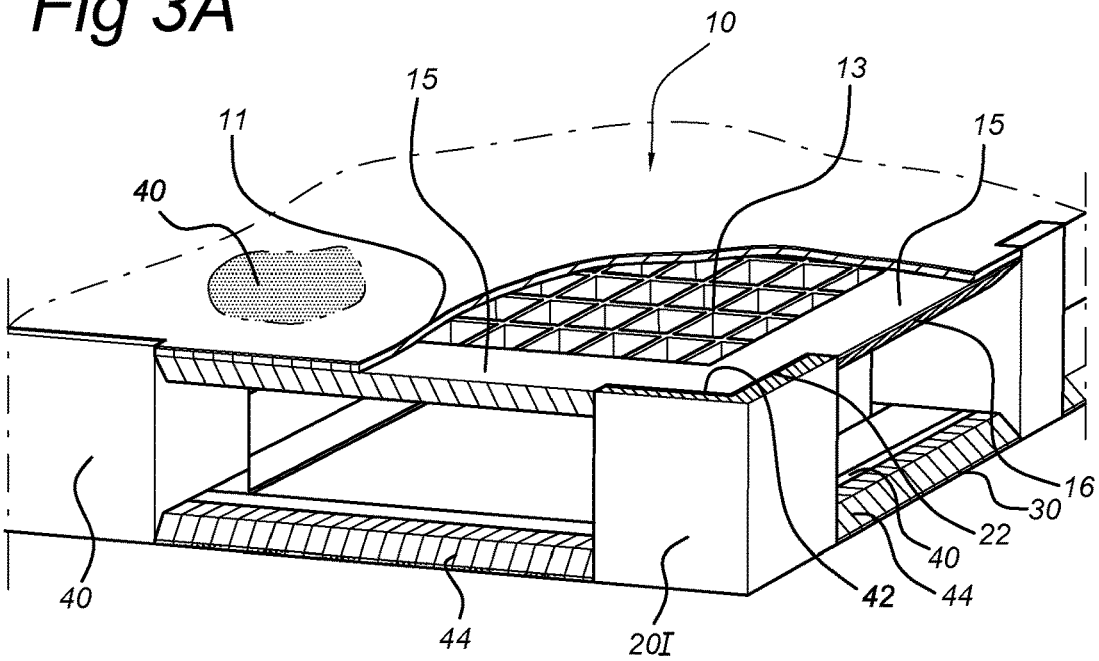
FIG. 3 shows a detail III of the pallet of FIG. 1 in partially cut-away view.
Figure 3B:
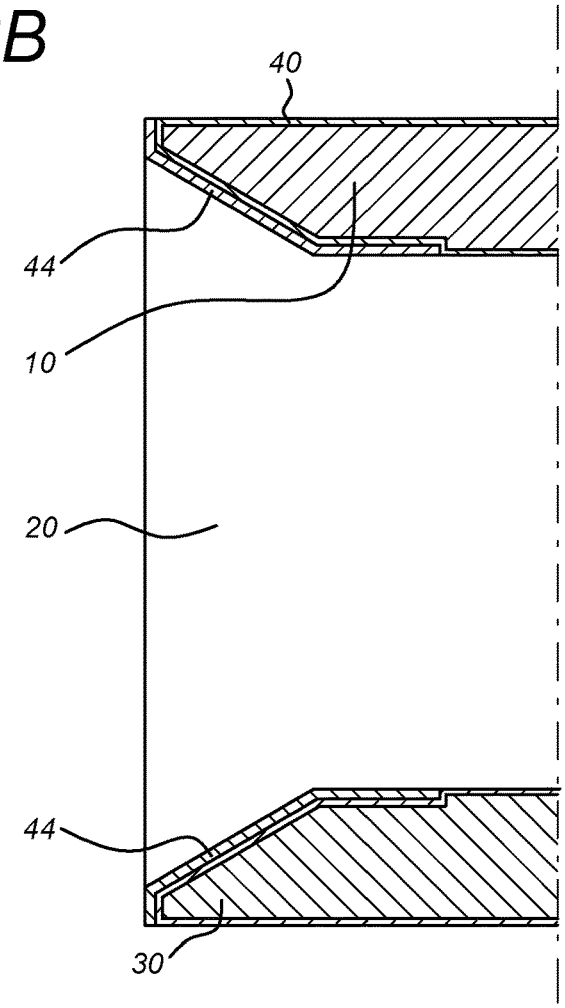

FIG. 3 shows an enlarged partially cut-away view of detail III in FIG. 1. According to this view, the deck 10 and part of the block 20I have been cut away to show the pallet construction. The deck 10 comprises an outer skin 11 of wood, covering an inner core 13 formed from slats of MDF material. In the illustrated embodiment, the skin 11 has a thickness of 3 mm. It will be understood that the outer skin may also be made of plywood, MDF or even of a composite e.g. laminated with fibre reinforced layers. Edge members 15, also of MDF, form the peripheral edge 16. These edge members 15 have a depth of 22 mm corresponding to the thickness of the core 13 and a width of 30 mm. This width is sufficient to allow cutaway regions 18 of around 15 mm, without unduly weakening the structure of the deck. The whole of the deck 10 is coated with a polyurethane resin coating 40, having a thickness of around 1 mm. The coating 40 provides a number of advantages to the pallet. Not only does it make the deck 10 stronger and more impact resistant but it is also waterproof, easily washable, anti-slip and can be used to provide a desirable colour or look.

The blocks 20 are also provided with the same coating 40 as the deck 10. They are glued to the deck 10 using an adhesive 42 that forms a relatively thick elastic bond between the elements. In the present embodiment, TEROSON MS 9399™ is used, which is a two-component modified silane adhesive available from Henkel. An advantage of this adhesive is that it remains elastic even after curing and, while being sufficiently strong to prevent undesired separation, ensures shock absorption in case of impact on the pallet 10. The adhesive joint can also be easily broken using a cutting wire.

The skid 30 is also provided with the same coating 40, which covers it entirely. Adhesive 42 connects the skid 30 to the blocks 20. Also visible in this view are bumpers 44 provided on chamfers 17, 37 of the deck 10 and skid 30 respectively. The bumpers 44 are HDPE strips that are glued to and cover the chamfers 17, 37. Although not visible in this view, the bumpers 44 may be recessed into the material of the deck peripheral edge 16 and skid peripheral edge 36 respectively.

In production, the deck 10, blocks 20 and skid 30 are individually manufactured in the form as shown in FIG. 2. The finished elements are then all coated with coating 40 prior to assembly. Electronic tag 60 is installed in the cavity 26 of the central block 20E and initialised. The tag 60 is battery powered and designed to operate for a period of up to 10 years based on normally expected usage. The blocks 20 are then adhered to the skid 30 using the adhesive 42 followed by application of the deck 10 with further adhesive 42 being placed onto the spacer portions 24 of the blocks 20. Once assembled, the tag 54 is sealed within the cavity 26 and can only be accessed in case of necessity by removal of the central block 20E. The bumpers 44 are then glued to over the chamfers 17, 37 and the barcode 52 is applied. Since it is desirable to have the same unique barcode 52 visible from each side of the pallet, application of the barcode preferably takes place by computer generation of a unique serial number for application as a barcode 52 to a first of the sides e.g. on block 20A. At subsequent locations in the automated production, the barcode 52 on block 20A may be read by an optical scanner and duplicated onto the other corner blocks 20C, 20G and 20I.

In use, the sleeve portions 22 and the bumpers 44 fully protect the deck peripheral edge 16 and the skid peripheral edge 36 from any lateral shock due e.g. to incorrect insertion of a fork-lift into openings 4. In the case that damage does occur to the pallet 1, the elements that are damaged may be removed from the pallet 1 and replaced. In the case of damage to a single block 20, this may be removed by use of a wire cutter to cut adhesive 42 and separate the block 20 from the deck 10 and skid 30. This may involve first the removal of the sleeve portion 22 e.g. by cutting it away from the spacer portion 24. If the deck 10 or skid 30 is damaged, removal of all sleeve portions 22 may be desirable in order to conveniently cut away the blocks 20.

Figure 4:
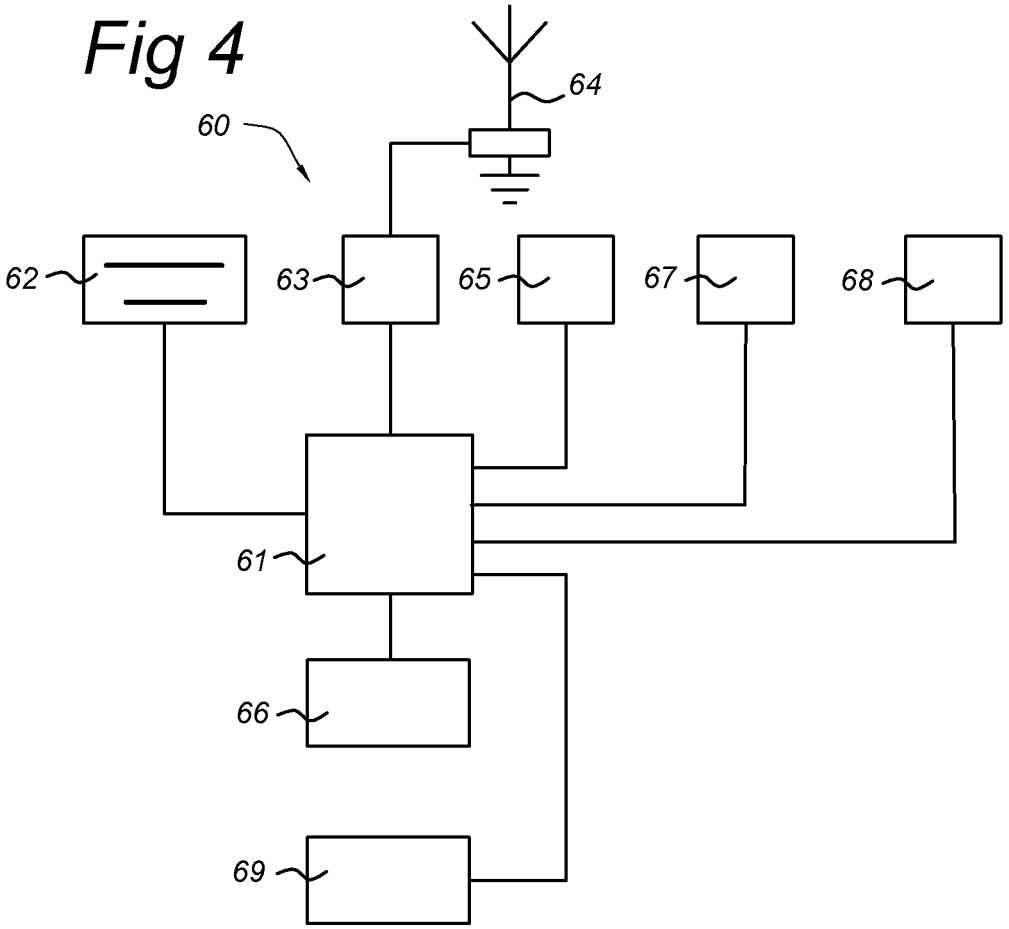
FIG. 4 shows a schematic view of the architecture of an electronic tag for use in the invention.

FIG. 4 gives a schematic overview of the architecture of electronic tag 60. Tag 60 includes a processor 61, a battery 62 an input-output device 63, antenna 64, memory 65 and clock 66, which operate in a conventional manner to enable the tag 60 to communicate over distances of up to 300 metres with a suitably arranged receiver according to standard protocols including Bluetooth, Wi-Fi, Zigbee, Zensys, LoRa, 6LoWPAN, 433 Mhz/868 Mhz/915 Mhz, 3G/4G/5G/LTE proprietary protocols or any other low power wide area network protocols.

The tag 60 is additionally provided with a temperature sensor 67, an accelerometer 68 and a weight sensor 69, all of which communicate with the processor 61. It will be understood that other sensors may also be included as required. In the case of the weight sensor 69, this is installed beneath the central block 20E and is calibrated during production to give a reading reflecting a distributed load supported on the deck 10. If required other calibrations may be applied depending on the nature of the product to be transported.

Figure 5:
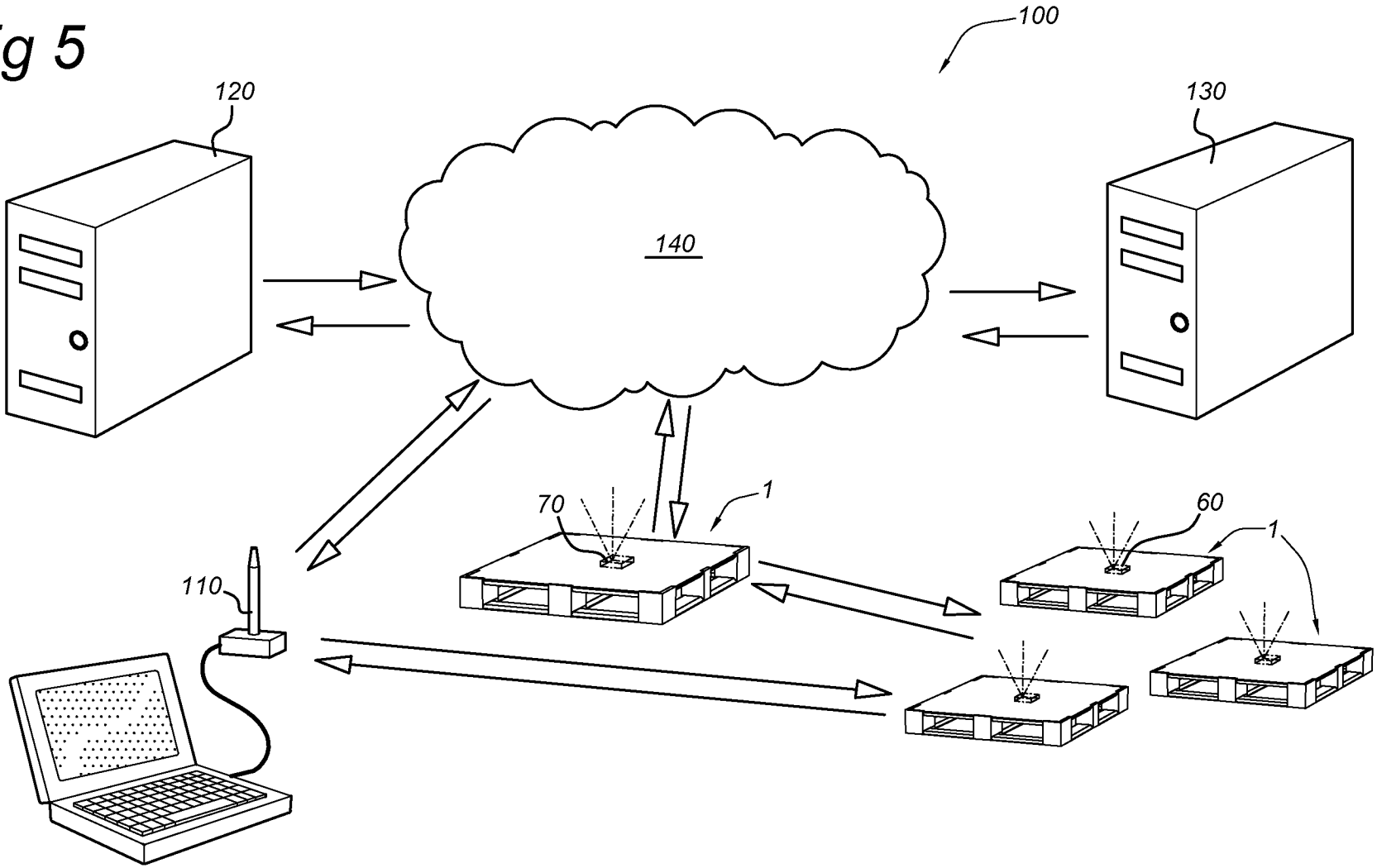
FIG. 5 shows a schematic view of a pallet logistic system according to the invention.

FIG. 5 gives a schematic overview of a pallet logistic system 100 according to one aspect of the invention. The system 100 comprises a plurality of pallets 1, a receiver 110, a network data server 120 and a customer server 130. The receiver 110, network data server 120 and customer server 130 are linked to each other through the Internet 140 and have Cloud data storage. The system 100 also includes a master pallet 1'. The pallets 1 are as described above, each of which including a respective electronic tag 60. The master pallet 1' is otherwise identical to the pallets 1, with the exception that it includes additional communication capability in the form of a gateway device 70 having a 3G modem chip enabling it to communicate directly with a telecom provider. It will be understood that other levels of communication may be equally applicable including 4G, 5G, LTE or other. The gateway device 70 is also enabled to interrogate the tags 60 of any normal pallets 1 that are within range.

Operation of the system 100 will further be described with reference to FIGS. 4 and 5. In normal operation, the tags 60 on pallets 1 communicate wirelessly with the receiver 110 to the extent that they are in range. This may be the case when they enter or exit a warehouse facility, whereby the receiver 110 is located at an entrance or exit. The receiver 110 may also be mobile, e.g. located onboard a lorry, train or vessel. The tags 60 are set to 'ping' or emit a signal containing status information at predetermined times. This time period varies according to the status of the pallet 1. If the pallet 1 is stationary, as determined by the accelerometer 68, the tag 60 pings every 60 minutes. If the accelerometer 68 detects motion of the pallet 1, the processor 61 instructs the input-output device 63 to ping every 60 seconds. In this manner, the life of battery 62 is preserved (these ping times are exemplary and may be varied according to the requirements of the situation).

The ping signal contains information stored by the memory 65 since the last communication with an external source. This may include data collected from the temperature sensor 67, the accelerometer 68 and the weight sensor 69, all of which is time stamped based on the clock 66 and provided with the pallet unique identity based on the barcode serial number 52. In this manner, complete data relating to the environment in which the pallet 1 has found itself can be recorded and subsequently transmitted. The ping signal is received by receiver 110, which acts as a gateway, for further transmission of the information to the internet 140. All this data is stored in the network data server 120, which will be used by the operator for operating the pallet pool. This network data server 120 will have the possibility to make available, via an Application Programming Interface or API, customer specific subsets of this data to customer servers 130 for use in their own IT systems.

In an alternative mode of operation, the gateway device 70 on the master pallet 1' is able to receive the ping signal from the pallets 1 when they are within range. This may be the case if the master pallet 1' is present in a consignment of normal pallets 1. In that case, the gateway device 70 may be able to continuously communicate data from the pallets 1 throughout their journey. The gateway device 70 can transmit this data directly to the internet 140.

It will be understood that based on the above system 100, the data that can be made available to the network data server 120 and the customer server 130 is limitless. Not only can data be generated in bulk relating to all pallets 1 within the system 100 but also individual data can be generated regarding the status of a particular pallet 1 and its load. The momentary position of a pallet 1 and its previous trajectory can be determined as can the environmental conditions (in this case temperature) to which it has been exposed. Additional sensors may be provided for all other detectable conditions that may be of interest. The condition of a pallet 1 may be determined by identifying sudden shocks or excessive loading using the respective accelerometer 68 and load sensors 69. This may be used to plan periodic maintenance or checks. Additionally, an individual pallet 1 may be interrogated by scanning the barcode 52 to directly determine its status. In this case, the barcode 52 allows an enabled mobile device such as a smartphone to extract data from the Internet 140 relating to recently received information transmitted from the tag 60 on the pallet 1.

Figure 6:
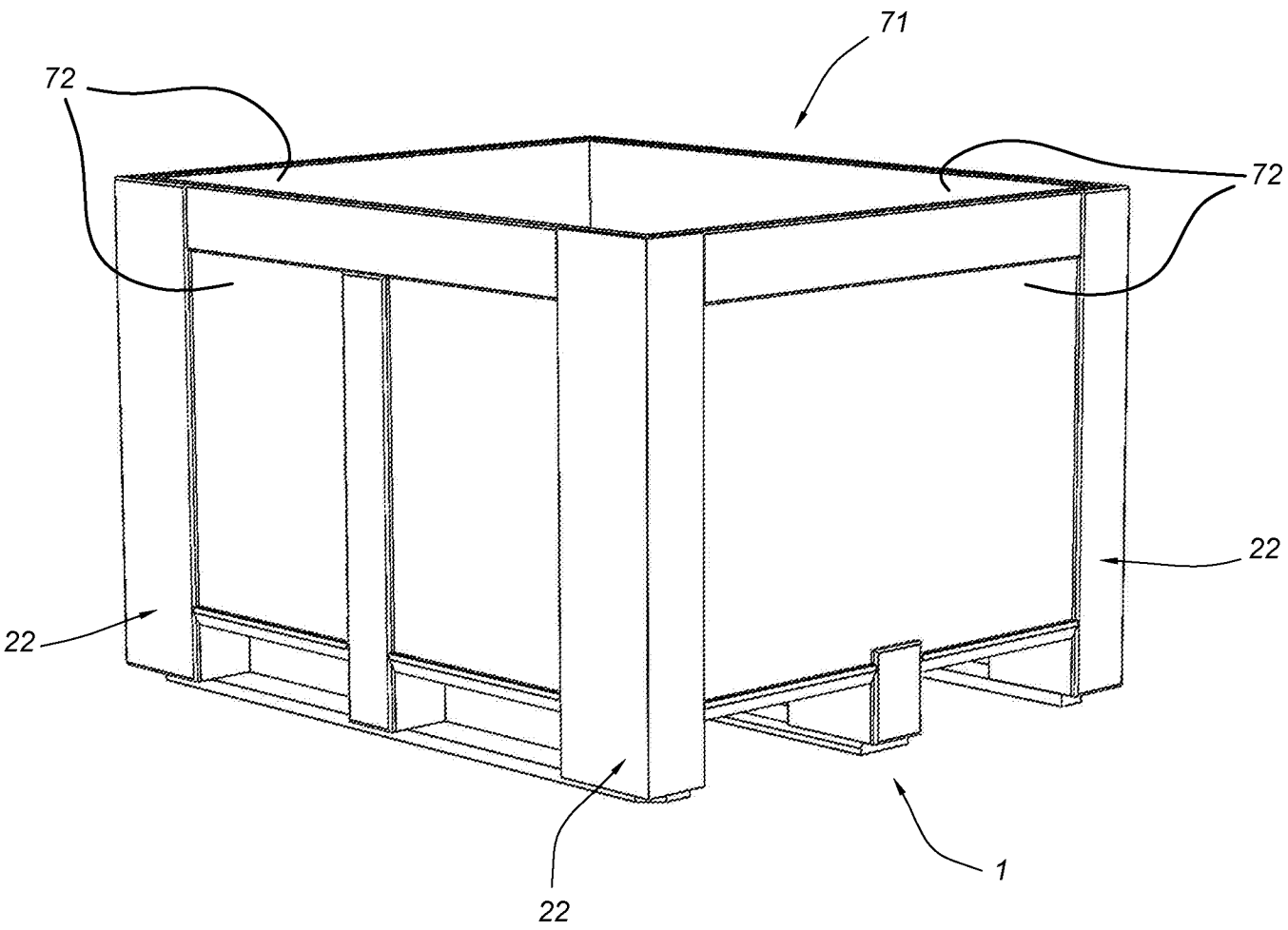
FIG. 6 shows a pallet according to the invention with side walls.

FIG. 6 shows a pallet 1 according to the invention with side walls 72. The pallet 1 with four side walls 72 form a so called box pallet 71. The pallet 1 of the invention is particularly suitable for building the box pallet 71. The reason is the sleeve 22 is simly extended vertically upward as shown. The extended sleeve 22 strength to the box construction. The sleeve 22 and side wall 72 are attached to one another in any suitable way for example by glueing.

Figure 7:
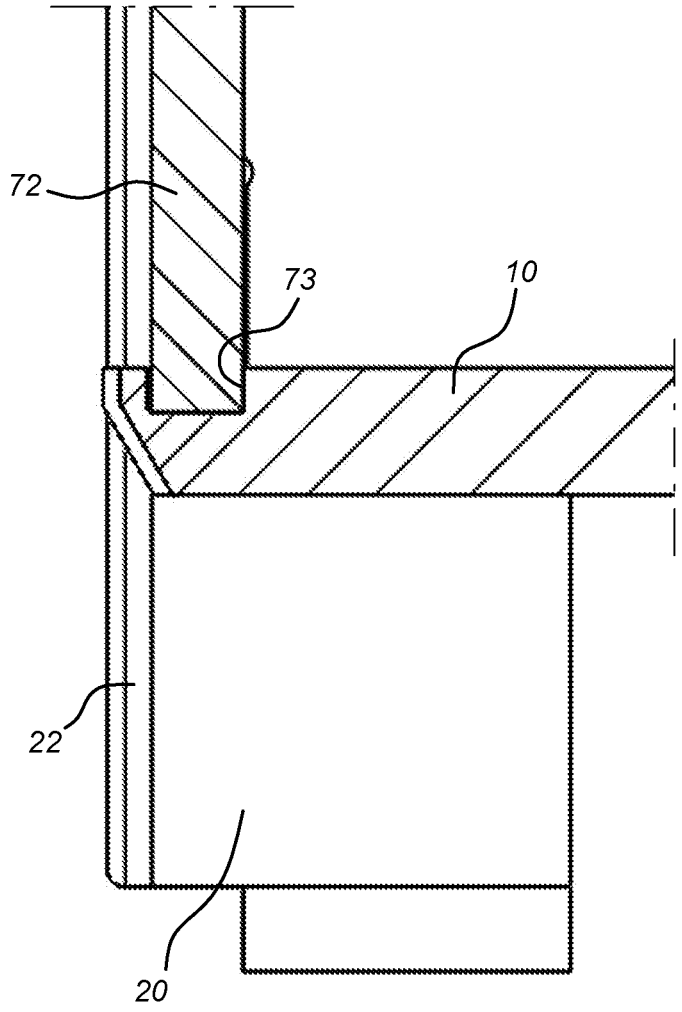
FIG. 7 shows a detail of FIG. 6.

FIG. 7 shows a detail of FIG. 6 in that a cross section is taken close to a corner of the box pallet 71. The deck 10 rests on a block 20. A slot 73 is arranged in the upper side of the deck 10. A side wall 72 extends partly into the slot 73 in order to give additional strength to the pallet box 71.

Thus, the invention has been described by reference to certain embodiments discussed above. It will be recognized that these embodiments are susceptible to various modifications and alternative forms well known to those of skill in the art. In particular, the pallet may be distinct from the schematically illustrated design.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A pallet, comprising:

a deck, having a deck upper surface, a deck lower surface and a deck peripheral edge;

a skid, having a skid upper surface, a skid lower surface and a skid peripheral edge; and a plurality of blocks, spacing the skid from the deck, the blocks comprising spacer portions and sleeve portions;

wherein the sleeve portions extend above and/or below the spacer portions and at least one of the deck and skid peripheral edges are cutaway such that at least one of the deck and skid can be recessed with the blocks, wherein the deck, the skid and the block are coated with a cured resin coating, wherein the deck, the skid and the blocks are individually connected to each other by means of an adhesive, and wherein the cured resin has a tensile strength $T_{resin}$ and the adhesive has a tensile strength $T_{adhesive}$ such that $T_{resin} > T_{adhesive}$.

2. The pallet according to claim 1, wherein the sleeve portions extend to level with at least one of the deck upper surface and the skid lower surface.

3. The pallet according to claim 1, wherein at least one of the deck and skid peripheral edges are cutaway by a distance corresponding to a width of the sleeve portions, whereby an exterior surface of the sleeve portions is co-linear with at least one of the deck and skid peripheral edges; and wherein at least one of the deck and skid peripheral edges are chamfered in the regions between the blocks to assist fork entry.

4. The pallet according to claim 1, wherein the deck, the skid and the blocks are each individually coated with a cured resin coating.

5. The pallet according to claim 4, wherein the resin coating has a thickness of from 0.5 mm to 1.5 mm.

6. The pallet according to claim 1, wherein the resin is a polyurea resin; a polyurethane resin; a polyaspartic resin; an epoxy resin; a polyurethane-polyurea hybrid resin; or a mixture thereof; and wherein the adhesive is a two-component modified silane, elastic adhesive.

7. The pallet according to claim 1, wherein the deck comprises a skin-core construction and the deck peripheral edge comprises an edge member having a width that is at least twice as great as a width of the sleeve portions; and wherein the deck peripheral edge is provided with a protective bumper.

8. The pallet according to claim 1, further comprising an electronic tag containing data identifying the pallet.

9. The pallet according to claim 8, wherein the electronic tag contains a wireless radio chip operating under a low power sensor network protocol such as WiFi, Bluetooth, Zigbee, Z-wave, BlueRobin and the like;

wherein the electronic tag further comprises a 3G/4G/5G/LTE, LoRa, Sigfox or other LPWAN modem chip; and wherein the electronic tag transmits a ping signal to a receiver or gateway device at adjustably programmable intervals.

10. The pallet according to claim 8, wherein the electronic tag is provided with a sensor to detect ambient conditions selected from the group consisting of temperature, humidity, light, UV radiation, CO2, and hazardous gas.

11. The pallet according to claim 8, wherein the electronic tag is provided with memory in order to store measurements and events.

12. The pallet according to claim 8, wherein the electronic tag is provided with a weight sensor, preferably located and mounted in or on the middle block, for detecting a load on the pallet; and wherein the electronic tag is provided with an activity monitor for detecting movement of or impact on the pallet.

13. A method of tracking a pallet having an electronic tag according to claim 8, the method comprising receiving information by wireless transmission from the electronic tag to a receiver.

14. The method according to claim 13, wherein the tag includes an activity monitor sensor for determining whether the pallet is in movement and the frequency at which information is transmitted is adjusted based on the presence or absence of movement;

wherein the tag includes an impact sensor and information relating to the time and degree of impact on the pallet is stored and subsequently transmitted to the receiver; and wherein the tag includes a temperature sensor and information relating to excessive temperatures is stored and subsequently transmitted to the receiver.

15. The method according to claim 13, further comprising providing a gateway device and transmission from the electronic tag to the receiver takes place via the gateway device; and wherein the gateway device comprises a wireless radio chip and a 3G/4G/5G/LTE modem chip.

16. The method according to claim 13, wherein information transmitted from the tag is stored in an internet database (cloud) and processed via smart algorithms so that the optimal routing of pallets can be determined and implemented.

17. A method of manufacture of the pallet according to claim 1, comprising providing a barcode to a first side of the pallet, generated from an computer system, and subsequently providing the other three sides of the pallet with the barcode, whereby the barcode on the first side is read with an optical scanner and then copied onto the other three sides of the pallet.

18. A method of repairing the pallet according to claim 1 when one or more of its elements is damaged, the method comprising:

removing a damaged element by cutting through the adhesive connecting the damaged element to a neighbouring element;

connecting a replacement element to the neighbouring element by means of adhesive.

19. The method according to claim 18, wherein cutting through the adhesive takes place using a cutting wire; and comprising removal of the sleeves prior to cutting through the adhesive.

20. A pallet logistic system comprising:

a plurality of pallets according to claim 1, each provided with an electronic tag capable of emitting a periodic communication signal (ping signal) containing data relating to that pallet;

a plurality of gateways, arranged to receive the ping signals from pallets that are within range and transmit the data to a publically accessible network;

a logistic management application running on a programmable device, the logistic management application enabling a user to extract the data from the network and analyse the data to determine individual and collective information regarding the plurality of pallets.

* * * * *